US005716034A

United States Patent [19]

Unkefer

[11] Patent Number: 5,716,034

[45] Date of Patent: Feb. 10, 1998

[54] APPARATUS FOR HANGING A BUCKET ON A LADDER

[76] Inventor: Lynn F. Unkefer, 413 Parkcrest Dr., Thiensville, Wis. 53092

[21] Appl. No.: 253,380

[22] Filed: Jun. 3, 1994

[51] Int. Cl.[6] ..... E06C 7/14

[52] U.S. Cl. ..... 248/211; 248/214; 248/340

[58] Field of Search ..... 248/210, 211, 248/238, 214, 255, 339, 340, 341

[56] References Cited

U.S. PATENT DOCUMENTS

| | | | |
|---|---|---|---|
| 1,283,160 | 10/1918 | Gross | 248/210 |
| 1,593,043 | 7/1926 | Stroecker | 248/210 |
| 1,854,069 | 4/1932 | Rowe | 248/210 |
| 2,444,986 | 7/1948 | Gebhardt | 248/210 |
| 2,522,658 | 9/1950 | Williams | 248/211 |
| 2,686,032 | 8/1954 | Thorson | 248/211 |
| 2,912,204 | 11/1959 | Raysinger | 248/210 |
| 3,163,389 | 12/1964 | Thornburgh | 248/211 |
| 3,312,441 | 4/1967 | Molenda | 248/210 |
| 4,053,131 | 10/1977 | Francis | 248/211 |
| 4,099,693 | 7/1978 | Blann | 248/210 |
| 4,403,368 | 9/1983 | Harper | 248/210 |
| 5,062,607 | 11/1991 | Kisner | 248/211 |
| 5,133,525 | 7/1992 | Good | 248/210 |

FOREIGN PATENT DOCUMENTS

| | | | |
|---|---|---|---|
| 2189535 | 10/1987 | United Kingdom | 248/210 |
| 2211236 | 6/1989 | United Kingdom | 248/210 |

*Primary Examiner*—Leslie A. Braun
*Assistant Examiner*—Gwendolyn W. Baxter
*Attorney, Agent, or Firm*—Michael Best & Friedrich LLP

[57] ABSTRACT

The invention provides a hanger for suspending a paint bucket from the rung of a ladder. The hanger includes an elongated member having an upper portion provided with a downwardly turned hook that can be placed around the rung to suspend the hanger from the rung. The elongated member also includes an upwardly turned hook from which the handle of the bucket is suspended, and a support member on the lower part of the elongated member that supports the side of the paint bucket. The upwardly turned hook, the downwardly turned hook and the support member are positioned to cooperate to hold the bucket beneath the ladder and tipped toward the ladder with the handle of the bucket held out of the way and the top of the bucket in an optimum position between the rungs of the ladder.

17 Claims, 2 Drawing Sheets

Fig. 1

APPARATUS FOR HANGING A BUCKET ON A LADDER

BACKGROUND OF THE INVENTION

1. Technical Field

The invention relates generally to an apparatus for suspending containers, and more particularly to an apparatus for hanging a container such as a paint can on a ladder, easel, or the like.

2. Related Prior Art

It is generally known to hang an open-top paint can or bucket from a ladder so that the bucket and its contents are accessible to a painter standing on the ladder. In one known arrangement for hanging a bucket a rope is tied between the handle of the bucket and a rung on the ladder. In a modified arrangement one end of the rope is fastened to the rung of the ladder and the opposite end of the rope is fastened to a paint can holder. An example of that modified arrangement is illustrated in U.S. Pat. No. 4,053,131.

In other known arrangements for supporting buckets on ladders hangers are supported at at least two locations by the ladder. Examples of such hangers are illustrated in U.S. Pat. Nos. 2,444,986 and 2,686,032 in which hangers are shown secured to both a rung and a side rail of a ladder; and in U.S. Pat. No. 5,062,607 in which a hanger is supported on a pair of rungs.

In still other known arrangements hangers are provided with first hook portions for suspending the hangers from the rung of a ladder and second hook portions for holding the handle of the bucket. An example of that arrangement is shown in U.S. Pat. No. 3,163,389.

SUMMARY OF THE INVENTION

Each of the above-discussed arrangements for suspending a bucket from a ladder suffers from some of several disadvantages. In particular, some of those arrangements fail to support buckets against twisting movement. This can cause difficulty when it is necessary to reach into the open top of the container. In other arrangements buckets are supported in positions that obstruct access to the bucket by a person standing on the ladder. For example, in some cases the bucket is positioned either too high or too low with respect to one of the rungs of the ladder so that the rung obstructs the open top of the container. In other arrangements buckets are supported in positions that interfere with normal use of the ladder or that subject the buckets to the risk of unintended contact which can cause spilling or other mishap. In other arrangements the handles of the buckets are held directly over the tops of the buckets thereby obstructing access into the buckets. In still other arrangements the bucket holders are incapable of supporting buckets in tilted positions to enhance access to the open tops of the buckets and to allow the contents of the buckets to pool in the front ends of the buckets as they are emptied. Additionally, some bucket holders are capable of holding only buckets of a certain size.

The invention provides an improved holder or hanger for suspending a container such as a paint bucket from a ladder. The hanger is easy to use and has a simple inexpensive construction that avoids the disadvantages of prior art hangers. In particular, the hanger is designed to suspend a bucket beneath the ladder when the ladder is in use so that the hanger and the bucket are out of the way to avoid accidental spillage and to permit full use of the ladder. The hanger is also designed to hold the bucket in a position tipped toward the ladder and to hold the handle of the bucket out of the way to make the open top of the bucket more accessible. To further improve accessibility, the hanger is configured to position the open top of the bucket between a pair of rungs on the ladder so that the rungs do not appreciably interfere with access to the bucket. Additionally, the hanger resists twisting and holds the bucket in a generally stable position under the influence of gravity and is capable of supporting nonstandard as well as standard size paint buckets.

More particularly, the invention provides a hanger for suspending a container from a support structure. In one embodiment the hanger is used to suspend a paint bucket from the rung of a ladder and includes an elongated member having an upper portion provided with a downwardly turned hook that can be placed around the rung to suspend the hanger from the rung. The elongated member also includes an upwardly turned hook from which the handle of the container is to be suspended, and a support member on the lower part of the elongated member is used to support the side of the paint bucket and to prevent the bucket from twisting. The upwardly turned hook, the downwardly turned hook and the support member are positioned to cooperate to hold the bucket beneath the ladder and tipped toward the ladder with the handle of the bucket held out of the way and the top of the bucket in an optimum position between the rungs of the ladder.

The invention also provides a hanger including an elongated member having a downwardly turned hook engageable with one of the rungs of a ladder for suspending the hanger from that rung so that the hanger is pivotable relative to the rung. The hanger is also provied with means including an upwardly turned hook for supporting a bucket in a tipped position such that the open top thereof has a vertical extent. The upwardly turned hook is engageable with the handle of a bucket to suspend the bucket from the hanger with the vertical extent of the open top being contained entirely within a vertical space defined between a pair of the rungs on the ladder. The upwardly turned hook also holds the handle to the side so that it forms an acute angle with the open top of the bucket. The means for supporting the bucket in a tipped position also includes a support member positioned below the upwardly turned hook. The support member includes an arcuate engaging surface that extends circumferentially around part of the bucket.

Various other features and advantages of the invention will become apparent to those skilled in the art upon review of the following detailed description, claims and drawings.

Figure 3:
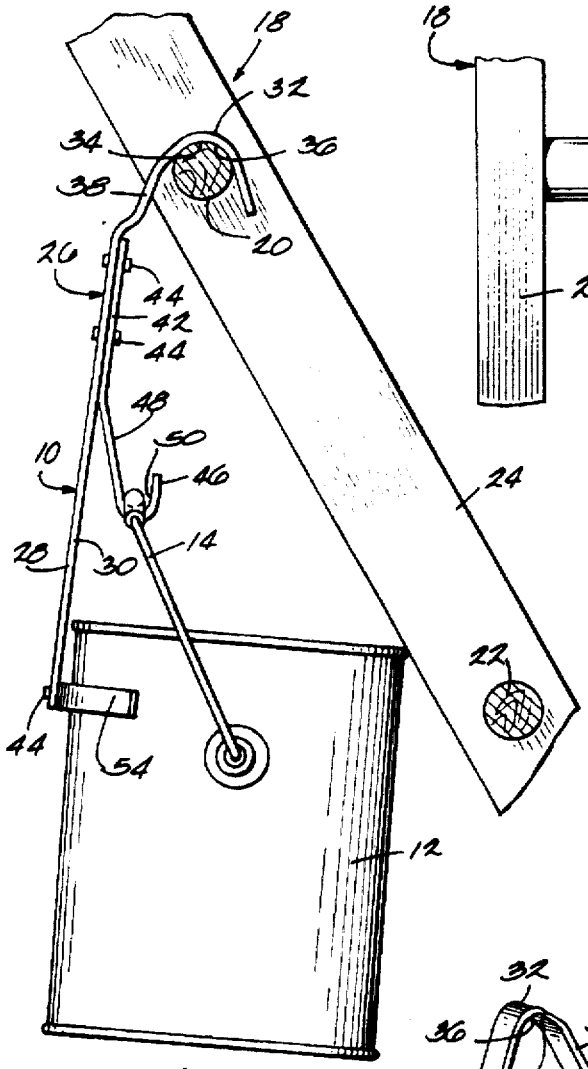
FIG. 3 is a side elevational view of the hanger shown suspended from a ladder and supporting a paint bucket.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Illustrated in the drawings is a hanger 10 for supporting a container, such as a standard paint can or bucket 12 having a pivotable bail or handle 14 and a cover (not shown) that is removable to expose an open top 16 (FIG. 4) to access paint (not shown) within the bucket 12. It will be understood by those skilled in the art that the hanger 10 could be used to suspend the bucket 12 from a variety of structures such as stands or easels, for example. In the illustrated arrangement the hanger 10 is used to suspend the bucket 12 from a ladder 18 (only a portion of which is shown) including horizontal rungs 20 and 22 (only two of which are shown) that extend between parallel side rails 24 (only one of which is shown).

Figure 4:
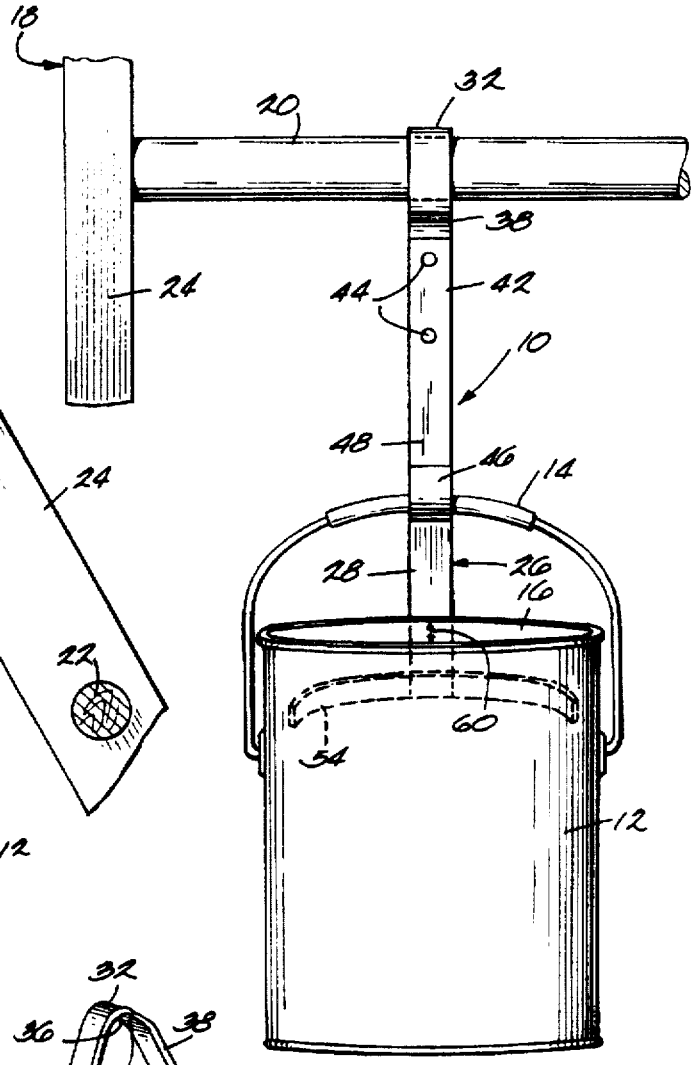
FIG. 4 is a front view of a portion of the combination shown in FIG. 3.

The hanger 10 is preferably made of metal and in one embodiment is fabricated from flat strips of aluminum that are fixed to one another to form a rigid one-piece structure. The hanger 10 includes an elongated member 26 having a first member or stem 28. The stem 28 includes a neck portion 30 and a portion that is bent to provide the upper part of the elongated member 26 with a downwardly turned hook 32 for supporting the hanger 10 (and the bucket 12 as explained below) from one of the rungs 20 on the ladder 18 as shown in FIGS. 3 and 4. When suspended by the downwardly turned hook 32, the hanger 10 is swingable or pivotable over a limited range relative to the rung 20.

The downwardly turned hook 32 includes a bearing or engagement surface 34 that remains in contact with the rung 20 when the hanger 10 is hung therefrom. The engagement surface 34 has a vertex 36 which, when the neck portion 30 is in a vertical position (see FIG. 2), is at approximately the uppermost point on the engagement surface 34. The downwardly turned hook 32 also includes an offset portion 38 that extends from the neck portion 30. The offset portion 38 extends horizontally (i.e., has a horizontal component 40 (FIG. 2)) to provide horizontal spacing between the neck portion 30 and the engagement surface 34, and particularly the vertex 36.

The elongated member 26 also includes means for suspending the bucket 12 from the hanger 10. In the illustrated arrangement the means for suspending the bucket 12 includes a second member 42 that is preferably fixed at one end to the neck portion 30 via suitable fasteners 44. The opposite end of the second member 42 is bent to form an upwardly turned hook 46 that is generally vertically coplanar with the downwardly turned hook 32 (see FIG. 4). The upwardly turned hook 46 includes a shank 48 that extends outwardly from the neck portion 30 and an engagement surface 50. When the bucket 12 is suspended from the upwardly turned hook 46 the handle 14 of the bucket 12 is held in contact with engagement surface 50. Engagement surface 50 has a vertex 52 which, when the neck portion 30 is vertical (FIG. 2), is at about the lowermost point of engagement surface 50.

Figure 1:
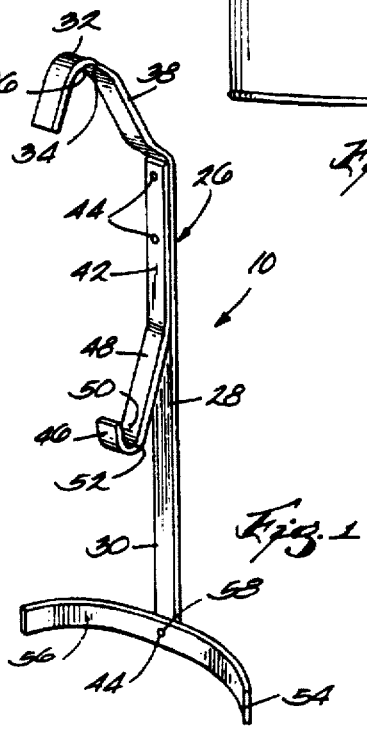
FIG. 1 is a perspective view of a hanger embodying the invention.

The hanger 10 also includes means for supporting the bucket 12 in a tilted or tipped position (shown in FIGS. 3 and 4) when it is suspended from the upwardly turned hook 46. In the illustrated arrangement such means includes a support member 54 which cooperates with the upwardly turned hook 46 to tip the bucket 12 as explained below. The support member 54 is preferably fixed to the lower part of the elongated member 26 via an additional fastener 44. The support member 54 has a generally arcuate configuration and extends circumferentially around the side of the bucket 12. The support member 54 also has (FIG. 1) an engagement surface 56 for contacting the side of the bucket 12. Engagement surface 56 has a vertex 58 positioned at about the midpoint of the support member 54 (i.e., the point of attachment of the support member 54 to the stem 30).

Figure 2:
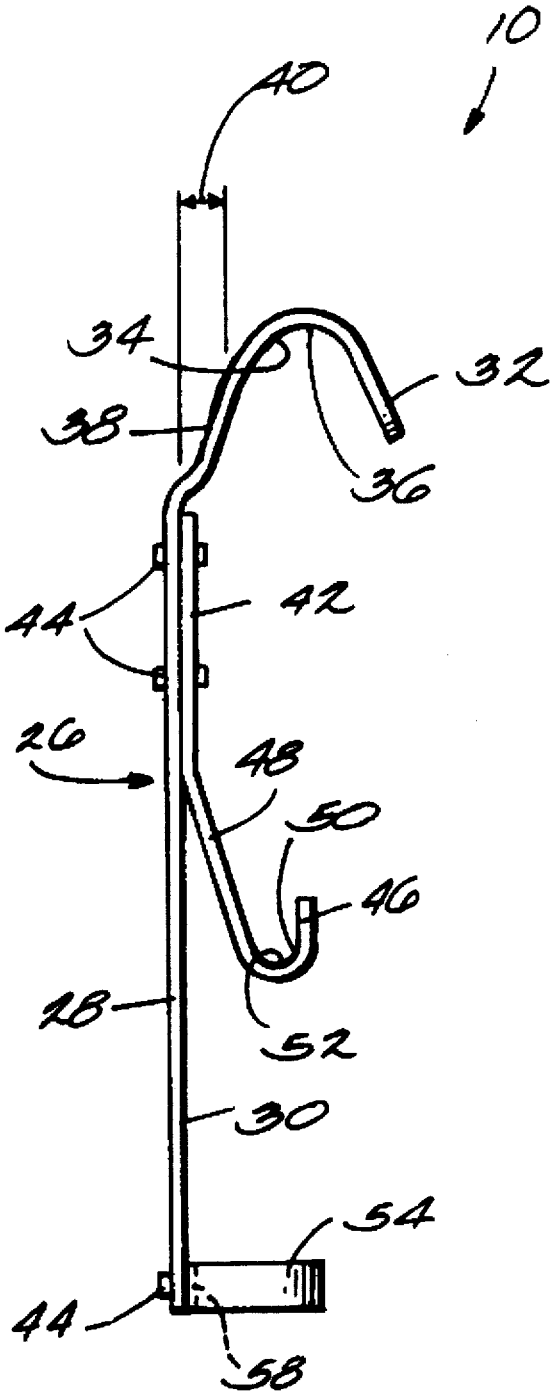
FIG. 2 side elevational view of the hanger illustrated in FIG. 1.

When the hanger 10 is placed in an upright position (FIG. 2), the engagement surfaces 34, 50 and 56, and particularly the vertices 36, 52 and 58 of those surfaces, are horizontally spaced relative to one another. As shown in FIG. 2, vertex 58 of the support member 54 is spaced horizontally from vertex 52 of the upwardly turned hook 46, which is in turn spaced horizontally in the same direction from vertex 36 of the downwardly turned hook 32. As shown in FIG. 3, when the hanger 10 and the bucket 12 are suspended from the rung 20, horizontal spacing between the vertices 36, 52 and 58 is increased somewhat. This is caused in part by the weight of the bucket 12 and the forces it exerts on the upwardly turned hook 46 and the support member 54. Those forces result in the creation of a moment on the hanger 10 about the axis of rung 20. That moment causes the hanger 10 and the bucket 12 to come to rest at an equilibrium position in which the bucket 12 is tilted so that the open top 16 of the bucket 12 lies in a plane that is transverse to the horizontal. In that position the open top 16 has a vertical extent 60 (FIG. 4) which increases accessibility to the contents of the bucket 12 by a person standing on the ladder 18. Also, since the hanger 10 and the bucket 12 are supported solely on the rung 20 and do not engage any other part of the ladder 18, the bucket 12 will be maintained at a tipped position and permitted to pivot a small amount as it is emptied.

Advantageously, the hanger 10 is configured so that the open top 16 of the bucket 12, and particularly its vertical extent 60, is positioned entirely within the vertical space defined between the rungs 20 and 22. This minimizes interference with access to the bucket 14 that could otherwise be presented by the rungs 20 and 22. Also, accessibility to the open top 16 is further improved by the upwardly turned hook 46 which, as shown in FIG. 3, holds the handle 14 at an acute angle relative to the open top 16 of the bucket 12 and substantially away from the open top 16. Additionally, the upwardly turned hook 46 and the support member 54 cooperate to prevent the bucket 12 from twisting relative to the hanger 10, and the hanger 10 and the bucket 12, under the influence of gravity, hang beneath the ladder 18 to tip the bucket 12 and to minimize interference with use of the ladder 18. Further advantageously, the hanger 10 can be used with buckets or containers of various sizes and is not limited to use with standard one gallon paint cans.

Various features and advantages of the invention will be set forth in the following claims.

I claim:

1. A hanger for suspending an open-top container, including a handle, from a ladder having a pair of side rails and a first rung and a second rung extending between the side rails, the first and second rungs defining a vertical space, said hanger comprising a one piece, unitary elongated member having a downwardly turned hook first engagable with the first rung to suspend said hanger from the first rung, said hanger adapted to be suspended between the side rails and adapted to be freely swingable about the first rung, and a second elongated member having a first end fastened to said first elongated member and said second elongated member having a second end having an upwardly turned hook from which the handle of the container is adapted to be suspended, and a support member extending from a second end of said first elongated member, said support member and said upwardly turned hook being arranged to hold the container in a position wherein the open top of the container is located within the vertical space defined by the first and second rungs and so that the open top of the container is accessible without interference from said first elongated member, said second elongated member, said support member or the handle of the container.

2. A hanger as set forth in claim 1 wherein said first elongated member includes a neck portion, and wherein said downwardly turned hook includes an engagement surface adapted to engage the rung, and an offset portion extending from said neck portion, said offset portion having an extent with a horizontal component so that said engagement surface is horizontally offset with respect to said neck portion when said downwardly turned hook is suspended from the rung.

3. A hanger as set forth in claim 1 wherein said first elongated member includes a neck portion, wherein said downwardly turned hook extends from said neck portion, wherein said downwardly turned hook has an engagement surface adapted to engage the rung so that said downwardly turned hook is swingable relative to the rung, and wherein said engagement surface is spaced horizontally from said neck portion, whereby when the bucket is suspended from said upwardly turned hook the open top of the bucket lies in a plane transverse to horizontal.

4. A hanger as set forth in claim 3 wherein said upwardly turned hook has an engagement surface adapted to engage the handle of the bucket, and wherein said engagement surface of said upwardly turned hook is spaced horizontally from said engagement surface of said downwardly turned hook.

5. A hanger as set forth in claim 1 wherein said support member is fixed to said first elongated member so that said hanger is an integral structure.

6. A hanger as set forth in claim 5 wherein said downwardly turned hook includes an engagement surface adapted to engage the rung so that said hanger is pivotable relative to the rung, wherein said upwardly turned hook includes an engagement surface adapted to engage the handle of the bucket, said engagement surface of said upwardly turned hook being horizontally spaced from said engagement surface of said downwardly turned hook, and said support member including an engagement surface adapted to engage the bucket, said engagement surface of said support member having a vertex spaced horizontally from said engagement surface of said upwardly turned hook.

7. A hanger as set forth in claim 1 wherein said downwardly turned hook and said upwardly turned hook open in opposed facing relation and are on the same side of said first elongated member.

8. A hanger as set forth in claim 1 wherein said first and second rungs define a plane, and wherein said first elongated member is suspended from the first rung and does not extend across the plane defined by the first and second rungs.

9. A hanger for suspending an open-top bucket including a pivotable handle, an upper edge and a lower edge from a ladder, said ladder including a pair of side rails and a rung extending between the side rails and defining an axis, said hanger comprising a one piece, unitary elongated first member having an upper portion and a lower portion, a second member having an upwardly turned hook rigidly fixed to said one piece, unitary elongated first member, said upwardly turned hook being adapted to hold the pivotable handle of the bucket, said elongated first member on said one piece, unitary upper portion of said one piece, unitary elongated first member, said downwardly turned hook being adapted to engage the rung to permit free pivotal movement of said hanger relative to the ladder about the axis defined by the rung, and a support member rigidly fixed to said one piece, unitary elongated first member on said lower portion of said one piece, unitary elongated first member, said support member being adapted to engage the bucket at a location between the upper and lower edges of the bucket and to extend arcuately around part of the bucket.

10. A hanger as set forth in claim 9 wherein said downwardly turned hook includes an engagement surface adapted to engage the rung of the ladder, said engagement surface of said downwardly turned hook including a vertex, wherein said upwardly turned hook includes an engagement surface adapted to engage the handle of bucket, said engagement surface of said upwardly turned hook including a vertex, wherein said support member includes an engagement surface adapted to engage the bucket, said engagement surface of said support member including a vertex, and wherein said vertex of said upwardly turned hook is spaced from said vertex of said downwardly turned hook in a horizontal direction, and said vertex of said support member is spaced from said vertex of said upwardly turned hook in said horizontal direction.

11. A hanger as set forth in claim 10 wherein each of said downwardly turned hook, said upwardly turned hook, and said support member are fixed on said elongated member so that said hanger is an integral structure.

12. A hanger as set forth in claim 11 wherein said downwardly and upwardly turned hooks are coplanar.

13. A ladder in combination with a bucket and a hanger for hanging the bucket on the ladder, said combination comprising a ladder including a pair of side rails and including a plurality of horizontal rungs, each rung defining an axis extending generally transverse to the side rails, a bucket including an open top, and a pivotable handle, an upper circumferential edge and a lower circumferential edge, and a rigid hanger for suspending said bucket from one of the rungs of the ladder, said hanger including a one piece, unitary elongated first member having a downwardly turned hook at a first end engagable with said one of the rungs for suspending said hanger from said one of the rungs between the side rails so that said hanger is freely pivotable relative to said one of the rungs about the axis defined by the rung, said downwardly turned hook having a width which prevents the said hanger from pivoting about a vertical axis, means for supporting said bucket in a tipped position such that said open top of said bucket has a vertical extent, said means for supporting said bucket in said tipped position including a second member having an upwardly turned hook rigidly fixed to said one piece, unitary elongated first member, said upwardly turned hook being positioned below said downwardly turned hook, said upwardly turned hook being engagable with said handle of said bucket to suspend said bucket from said hanger, said bucket being suspended solely by the upwardly turned hook so that said vertical extent of said open top is contained entirely within a vertical space defined between said one of the rungs and another of the rungs positioned immediately below and adjacent said one of the rungs, and said upwardly turned hook holding said handle such that said handle forms an acute angle with said open top of said bucket so that said handle is positioned away from said open top of said bucket, and a support member rigidly fixed to a second end of said one piece, unitary elongated first member, said support member being positioned below said upwardly turned hook, and said support member including an arcuate engaging surface, said arcuate engaging surface extending arcuately around part of said bucket and engaging said bucket at a location intermediate the upper and lower circumferential edges of said bucket.

14. A hanger as set forth in claim 13 wherein each of said downwardly turned hook, said upwardly turned hook, and said support member are fixed on said first elongated member so that said hanger is a rigid one-piece structure.

15. A hanger as set forth in claim 14 wherein said downwardly and upwardly turned hooks are coplanar.

16. A hanger as set forth in claim 15 wherein said hanger and said bucket are supported solely on said one of the rungs.

17. A hanger as set forth in claim 16 wherein said downwardly turned hook includes an engagement surface engaging said one of the rungs, said engagement surface of said downwardly turned hook including a vertex, wherein said upwardly turned hook includes an engagement surface engaging said handle, said engagement surface of said upwardly turned hook including a vertex, wherein said engagement surface of said support member includes a vertex, and wherein said vertex of said upwardly turned hook is spaced horizontally from said vertex of said downwardly turned hook in a direction away from said ladder, and said vertex of said support member is spaced horizontally from said vertex of said upwardly turned hook in said direction away from said ladder.

* * * * *

UNITED STATES PATENT AND TRADEMARK OFFICE

CERTIFICATE OF CORRECTION

PATENT NO. : 5,716,034

DATED : February 10, 1998

INVENTOR(S) : Lynn F. Unkefer

It is certified that error appears in the above-indentified patent and that said Letters Patent is hereby corrected as shown below:

In claim 1, Column 4, line 57, after "elongated" and before "member" insert --first--

In claim 1, Column 4, line 58, after "hook" and before "first" insert --at a--; and after "first" and before "engageable" insert --end--

In claim 9, Column 6, line 3, after "said" and before "elongated" insert --one piece, unitary--

In claim 9, Column 6, line 3, after "member", delete "on said one piece, unitary"

In claim 9, Column 6, line 4, before "upper" insert --having a downwardly turned hook extending from said--

Signed and Sealed this

Twenty-eighth Day of April, 1998

Bruce Lehman

*Attest:*

BRUCE LEHMAN

*Commissioner of Patents and Trademarks*

*Attesting Officer*